US006796097B2

(12) United States Patent
Fensel et al.

(10) Patent No.: US 6,796,097 B2
(45) Date of Patent: Sep. 28, 2004

(54) ROOF OR WALL PANEL SYSTEM AND METHOD OF INSTALLATION

(75) Inventors: Fred A. Fensel, Cleveland, OH (US); Michael Huber, Akron, OH (US)

(73) Assignee: The Garland Company, Inc., Cleveland, OH (US)

( * ) Notice: Subject to any disclaimer, the term of this patent is extended or adjusted under 35 U.S.C. 154(b) by 209 days.

(21) Appl. No.: 10/212,009

(22) Filed: Aug. 2, 2002

(65) Prior Publication Data

US 2004/0020150 A1 Feb. 5, 2004

(51) Int. Cl.[7] ..... E04C 2/30

(52) U.S. Cl. ..... 52/468; 52/465; 52/586.1; 52/588.1; 52/762

(58) Field of Search ..... 52/468, 465, 586.1, 52/588.1, 762, 24, 25, 520, 28, 540, 45, 536, 38, 745.21, 698, 461, 462, 1, 4, 309.11, 580, 86, 594, 579, 588, 528, 593, 595, 469, 640, 539, 394, 463, 309.1, 309.9, 478, 544

(56) References Cited

U.S. PATENT DOCUMENTS 380,864 A * 4/1888 Cooper
3,749,826 A * 7/1973 Hawes ..... 287/189.36
4,075,811 A * 2/1978 Keith ..... 52/395
4,128,983 A * 12/1978 Matsubara ..... 52/731
4,196,554 A * 4/1980 Anderson et al. ..... 52/394
4,322,924 A * 4/1982 Cooper ..... 52/57
4,481,747 A * 11/1984 Tengesdal et al. ..... 52/460
4,648,231 A * 3/1987 Laroche ..... 52/235
4,744,185 A * 5/1988 Lamberet et al. ..... 52/309.11
5,038,543 A * 8/1991 Neyer ..... 52/528
5,062,250 A * 11/1991 Buzzella ..... 52/584
5,685,118 A * 11/1997 Simpson ..... 52/520
6,112,493 A * 9/2000 Rickman ..... 52/640
6,164,033 A * 12/2000 Haddock ..... 52/545
6,553,739 B2 * 4/2003 Richardson ..... 52/734.2
6,591,557 B1 * 7/2003 Thomsen et al. ..... 52/90.1

* cited by examiner

*Primary Examiner*—Jeanette E. Chapman
(74) *Attorney, Agent, or Firm*—Hahn Loesser +Parks LLP; Stephen L. Grant

(57) ABSTRACT

A light-weight structural system is provided by a panel system having at least one pair of adjacent panels (10) and a clip (60) positioned between the adjacent panels. A groove or channel (26) in each panel receives an outwardly-extending tongue or tab (70) on the clip. Built-up gussets (28, 30) on the panels above and below the groove or channel provide structural strength. Upwardly-extending support members (64, 66) on the clip bear weight from the panels. A base section (62) of the clip allows the clip to be fixed to a roof or wall substructure. The panels can be formed from thermosetting or thermoplastic polymers, especially fiber-reinforced polymers.

15 Claims, 2 Drawing Sheets

FIG.-5
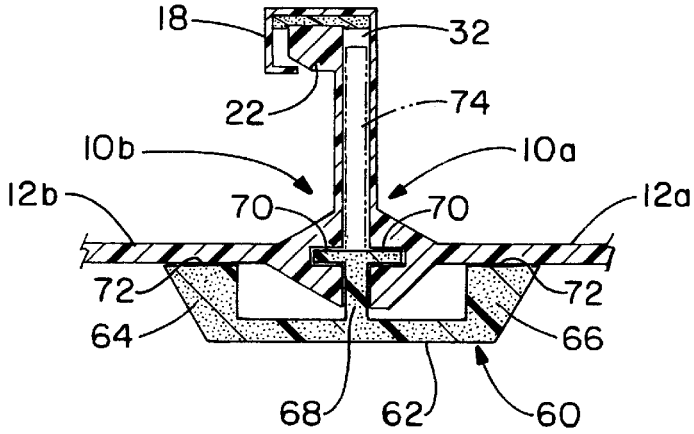
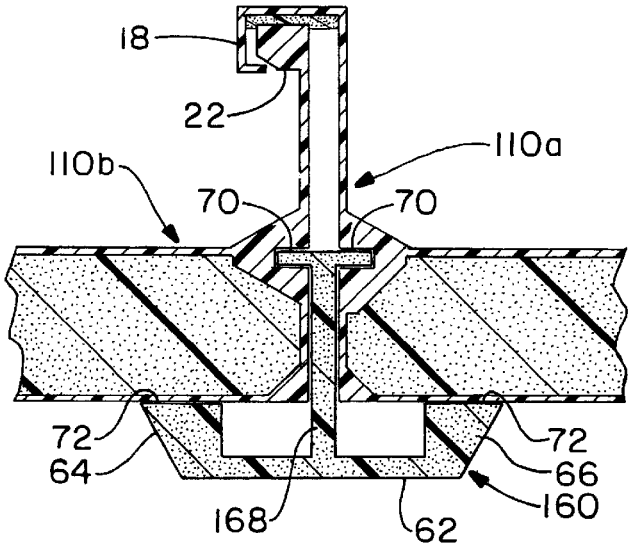
FIG.-6
FIG.-7
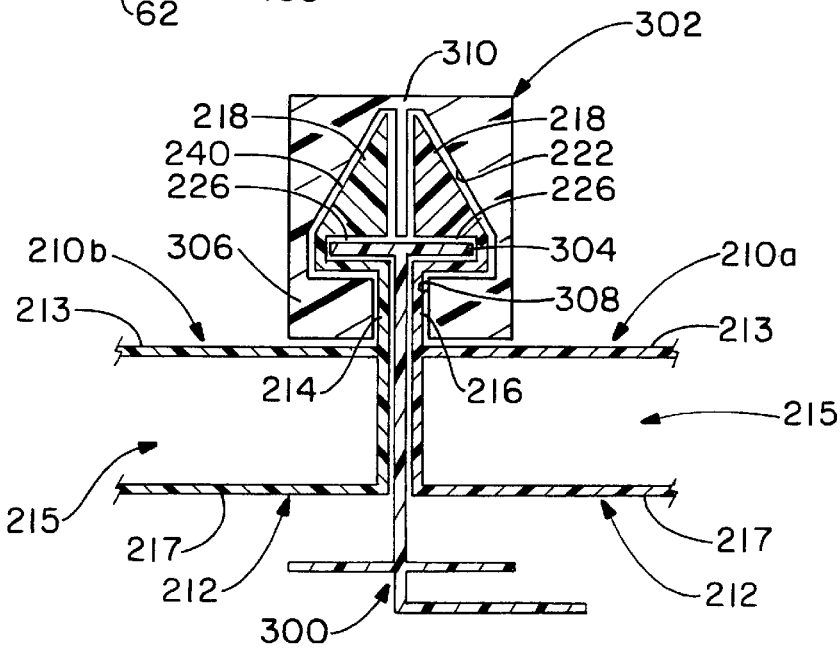

ROOF OR WALL PANEL SYSTEM AND METHOD OF INSTALLATION

The present invention relates to a panel system and a method of installing a light weight structural system to provide a safe, long lasting, weatherproof, maintenance free surface. The panel may be a composite material with fiberglass reinforced polymer (FRP). It may be covered with a gel coat or a painted finish. The panel provides structural strength to support loads and forces as a combination roof and decking material as well a sidewall construction building panel.

BACKGROUND OF THE ART

The present invention is a non-metal panel system with advantages over known metal panel systems, metal panel foam laminate systems, FRP panel systems, and FRP foam combination panel systems.

Prior art metal panel roof systems are traditionally divided into two categories, architectural and structural. An architectural system is generally a steep slope system, used for visual impact or aesthetics. It typically requires a supporting deck with a minimum slope of 3 inch per foot of slope with water shedding or hydrokinetic seams. A structural system will tend to be a low slope system, although a minimum of ¼ inch per foot of slope is typically used to provide runoff. A structural system can support its own weight without a deck. The seams of a structural system are water tight or hydrostatic and are designed to withstand water pressure.

These types of metal panels and seams come in a variety of shapes and sizes. Panels profile or shapes can be of corrugated style design, trapezoidal rib, flat, or a specialty design. Seams may have an interlocking or meshing male/female design, although non-meshing ends covered with a cap are also used. The seams may be hand formed, roll formed, or brake formed. Types of seam can include flat, corrugated, trapezoidal rib, batten, vertical leg. The term "standing seam" is often used as a generic description for most kinds of metal roofing. It comes from the fact that the seams stand vertically upright above the panel flats. Because a standing seam located above the panel is therefore out of the path of water that is either shedding from the roof or ponding or accumulating on the roof, the standing seam provides superior waterproofing, even when a hydrostatic seal of the seam may fail. These panels may be attached to supporting substructures with through panel fasteners. A number of fastening means are known, but a common means is a simple bolt and washer assembly with a variety of sealing methodologies. There are a variety of other attachment methods that do not require penetration of the panel surfaces, such as the clip system described in U.S. Pat. No. 4,649,684 to Petree. Another non-penetrating fastener is that taught by Greenberg in U.S. Pat. No. 5,737,892.

The same type of panels and seaming techniques are used commonly in the sidewall panels of buildings as are used in roofs, although waterproofing is a reduced concern. These panels are of metals, such as steel, copper, aluminum, etc., of typical thicknesses about 0.015 inches to about 0.051 inches. Similar to this type of metal panel roof and wall construction is roof and wall panel construction composed of panels that contain an insulated core with outer- or inner metal skins with similar design profiles and patterns.

Today, fiberglass-reinforced polymer panel roof and wall panel construction is similar, if not identical to, metal panel roof and wall construction. A primary difference is that FRP panel or panel system does not use a through panel attachment methodology combined with a standing seam lateral adjoinment. Lateral flat panel seams and longitudinal flat seams often require a field applied sealant, especially in combination with some form of sealing member, such as a gasket. These seams are vulnerable to problems in field craftsmanship as well as the durability and maintenance of the sealant used. In other words, an otherwise acceptable or even superior FRP panel roofing system can result in complaints against the manufacturer due to factors beyond that manufacturer's control. One FRP panel system using through panel attachment methodology and flat overlap seams is described in U.S. Pat. No. 5,625,999 to Buzza.

Other plastic panel technology that has been developed in recent years includes the panel coupling assemblies of Conterno, assigned to Politec Polimeri Tecnici S. A. of Italy, as disclosed in U.S. Pat. No. 6,347,495 B1 (Feb. 19, 2002) and U.S. Pat. No. 6,202,382 B1 (Mar. 20, 2001).

It is a previously unmet object of the invention to provide a non-metal panel system that employs a non-penetrating method of attachment, to eliminate penetrating fasteners that are the source of leaks, which require routine maintenance to ensure their tightness or attachment and watertight seal and which restrain movement of the panel from expansion, contraction and other stresses.

SUMMARY OF THE INVENTION

This and other objects of the invention are provided by a panel system for attaching to a substructure of a roof or a wall. Such a panel system comprises at least one pair of adjacent panels and at least one clip for connecting each said pair of adjacent panels. Each of the panels comprises an elongate body with a base section having first and second side edges. A first leg is attached at a first end thereof at the first side edge and a second leg is attached at a first end thereof at the second side edge. These first and second legs extend generally perpendicularly from the base section. Each side edge further comprises a groove or channel. In order to attach the first leg of a first panel to the second leg of a second panel, each of the first and second legs has one of a complementary pair of mating means arranged at a second end therof. Each of the clips comprises a flat bottom that is arranged and designed to have a bottom surface fastened to the substructure. Each clip further has a left, a right and a central support member that extends from an upper surface of the flat bottom. Each of the left and right support members has an enlarged upper surface for bearing against the base section of a panel and receiving its weight. The central support member has a pair of outwardly extending tongues or tabs to be received in the channel or groove of the panels. At least one clip fits between each pair of the adjacent panels.

BRIEF DESCRIPTION OF THE DRAWINGS

The present invention will best be understood when reference is made to the detailed description of the invention and the accompanying drawing, wherein identical parts are indentified by identical reference number and wherein:

FIG. 5 shows a clip being used to fasten a pair of first embodiment panels;

FIG. 6 shows a clip being used to fasten a pair of second embodiment panels; and FIG. 7 shows a cross sectional view of two panels of a third embodiment of the present invention being joined by a clip.

DETAILED DESCRIPTION OF THE INVENTION

Figure 1:
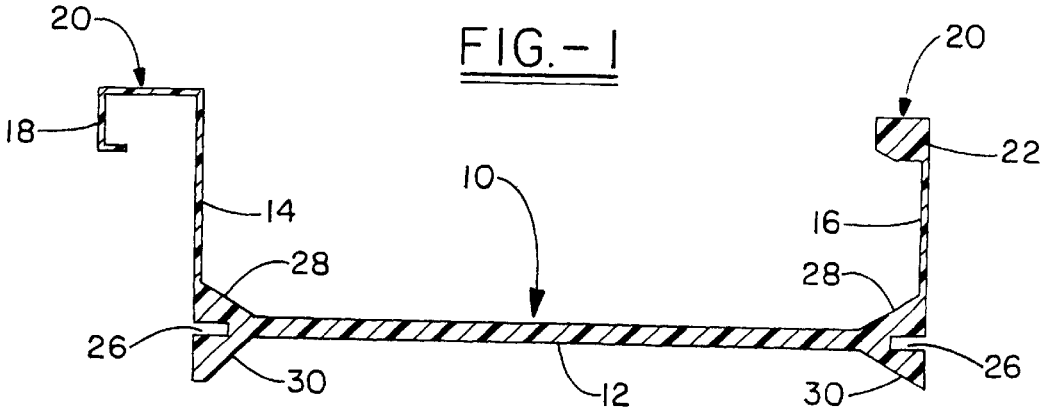
FIG. 1 shows a cross sectional view of a first embodiment panel.

FIG. 1 shows an end or cross section view of the panel 10 of a first embodiment of the present invention, it being understood that this cross sectional profile of the panel 10 is consistent throughout a longitudinal direction of the panel, that longitudinal direction extending normal to the plane of the drawing sheet. For that reason, the section depicted could occur anywhere along the longitudinal direction. The panel 10 comprises a generally U-shaped elongate body having a planar base section 12 with first and second vertical legs 14, 16, one of the legs positioned at the two side edges of the base section, that is, the sides when viewed in the cross section view as presented. One of the vertical legs, in this case, first vertical leg 14, has a first part 18 of a means 20 for mating disposed at a top end thereof. The other vertical leg, that is, second vertical leg 16, has a second part 22 of the mating means 20 disposed at a top end thereof. In the partical embodiment shown, the first mating means part 18 is a female portion and the second mating means part 22 is a male portion.

Figure 2:
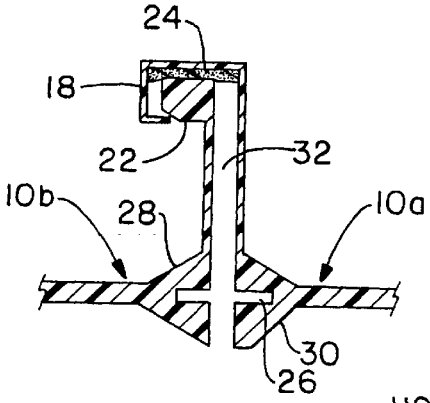
FIG. 2 shows a cross sectional view of ends of first embodiment panels being joined together.

The juxtaposition of two adjacent panels 10*a,* 10*b* is shown in FIG. 2. In the embodiment illustrated, the second mating means part 22 on panel 10*b* fits into the first mating means part 18 of panel 10*a,* forming the vertical standing seam. A longitudinal strip or band 24 of a resilient sealent of gasket can be applied to one of the mating faces of the first or the second mating means parts 18, 22 to render the seam water-tight. If this strip or band 24 is adhered to one of the mating means parts 18, 22, it should not be adhered to the other, as adhesion to both the first and second mating means parts 18, 22, could result in restraining the panels from expansion in the longitudinal direction, causing stresses in the panel. However, it is desirable that the strip or band 24 be maintained in compression by the mating of parts 18, 22.

FIGS. 1 and 2 also show another feature of the panel 10. Each side edge is also provided with a groove or channel 26, intended to receive a tongue of a clip, as described in more detailed below. For structural integrity, as well as for facilitating the guiding of the panels 10 into place, each groove or channel 26 has a pair of built-up gussets 28, 30, one of the gussets above the channel and the other below the channel. Also notable in FIG. 2 is the vertical channel 32 available for receiving an upstanding member of the clip used to secure the panel assembly to the roof.

Figure 4:
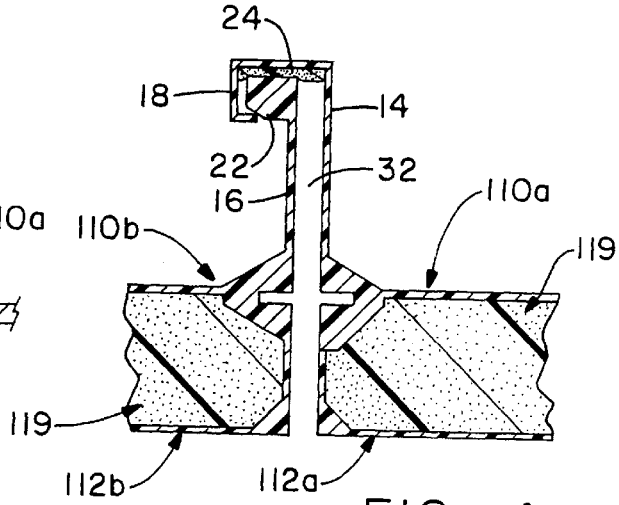
FIG. 4 shows a cross sectional view of ends of second embodiment panels being joined together.
Figure 3:
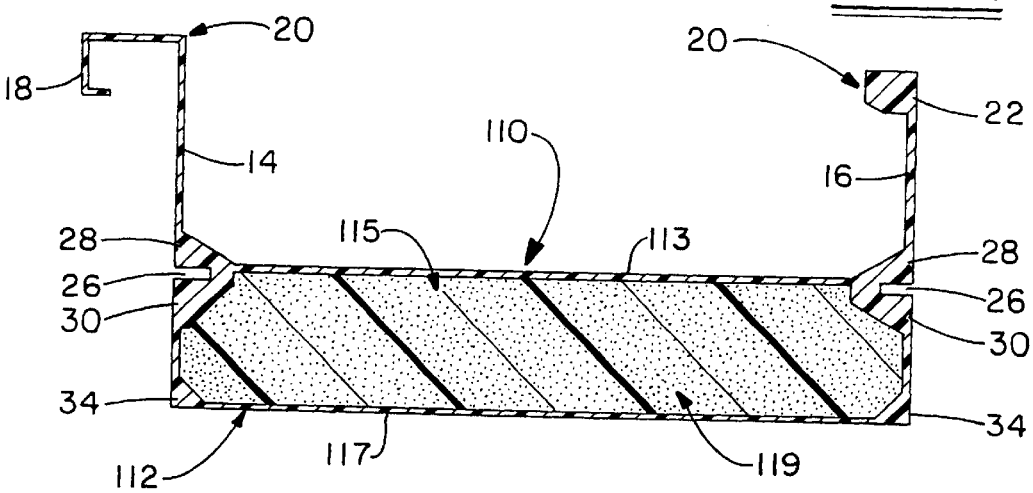
FIG. 3 shows a cross sectional view of a second embodiment having an insulative hollowed or foam containing underlying inner core.

FIGS. 3 and 4 are similar to FIGS. 1 and 2, but illustrate a second embodiment of the present invention. FIG. 3 shows an end or cross section view of the panel 110 of this second embodiment, it again being understood that this cross sectional profile of the panel 110 is consistent throughout a longitudinal direction of the panel, that longitudinal direction extending normal to the plane of the drawing sheet. For that reason, the section depicted could occur anywhere along the longitudinal direction. The panel 110 comprises a generally U-shaped elongate body, but the base section 112 is no longer a relatively thin plane, but is instead a top plane 113 with an underlying cavity 115, bounded by a bottom plane 117, the cavity being shown in FIG. 3 as being filled with an insulative foam 119. The first and second vertical legs 14, 16 are identical to those in FIGS. 1 and 2, and they operate identically, with means 20 for mating comprising a first part 18 disposed at a top end of first vertical leg 14 and a second part 22 disposed at a top end of second vertical leg 16. As in FIGS. 1 and 2, the first mating means part 18 is a female portion and the second mating means part 22 is a male portion.

The juxtaposition of two adjacent panels 110*a,* 110*b* is shown in FIG. 4. In the embodiment illustrated, the second mating means part 22 on panel 110*b* fits into the first mating means part 18 of panel 10*a,* forming the vertical standing seam. A longitudinal strip or band 24 of a resilient sealent or gasket can be applied to one of the mating faces of the first or the second mating means parts 18, 22 to render the seam water-tight. If this strip or band 24 is adhered to one of the mating means parts 18, 22 it should not be adhered to the other, as adhesion to both the first and second mating means parts 18, 22, could result in restraining the panels from expansion in the longitudinal direction, causing stresses in the panel. However, it is desirable that the strip or band 24 be maintained in compression by the mating of parts 18, 22.

FIGS. 3 and 4 also show another feature of the panel 110. Each side edge is also provided with a groove or channel 26, intended to receive a tongue of a clip, as described in more detail below. For structural integrity, as well as for facilitating the guiding of the panels 110 into place, each groove or channel 26 has a pair of built-up gussets 28, 30, one of the gussets above the channel and the other below the channel. Also notable in FIG. 2 is the vertical channel 32 available for receiving an upstanding member of the clip used to secure the panel assembly to the roof. Additionally a gusset 34 is shown in the cavity 117 as providing support. In the second embodiment, the vertical channel is longer, as it extends significantly below the channel 26.

One method of securing the panel 10 of the present invention to roof is shown in FIG. 5, where a clip 60 is disclosed and is shown in side section. The clip 60 can be a continuous member or it can be discontinuous, depending on the particular amount of support needed in a particular application. The clip 60 has a flat bottom 62, which may be seated upon and secured to an underlying building member, such as a purlin (not shown). The clip also has three upstanding members extending up from the bottom. These are the left and right supports 64, 66 and a central support 68. In the embodiment shown, the central support 68 terminates at an upper end in a pair of horizontal tabs 70 which fit into the channels 26 of the panel 10, while upper surfaces 72 of the left and right supports provide support to the planar portion 12 of the panel. In at least one additional design, the central support could extend further upwardly into the vertical channel 32, as is shown in broken lines as part 74. Of course, other clip options are available for securing the panels to the building. As noted the clip 60 can vary in length and size, and may even be continuous in length spanning the entire gap between adjacent purlins. This type of clip design allows the panel to expand/contract over its length along the channels/grooves freely. In essence the panel and panel system is free floating in the longitudinal direction. Panel weight is borne by upper surface 72 and tabs 70.

FIG. 6 shows a second clip 160 for securing the panel 110 of the present invention to a roof. This clip 160 is similar to clip 60, but the central support 168 is significantly longer to account for the thicker base portion of the panel 110.

It will be appreciated that the clips 60, 160 described do not require any penetration of the panels to secure them to the roof and the clips do not impede longitudinal movement of the panels along the clip, thereby allowing expansion, contraction, etc. of the panels. Similarly, a degree of lateral movement is also allowed by the clip design.

In the embodiment of the panel shown in FIGS. 3 and 4, the panel may have a plastic or resin portion comprising phenolic, epoxy, polyester, vinyl ester, and polyurethane resins among others. The fiberglass portion of the panel may include chopped strands of fiberglass, fiberglass rovings, a variety of fiberglass mats from wet laid process, woven, laminated, or stitch knitted, and variety of other processes including a variety of additional reinforcing materials such as polyester, carbon, KEVLAR, etc. In some embodiments, at least the exterior or weather bearing surface of the panel may be painted or covered with a gel coat.

The panel profiles envisioned by this disclosure may formed by continuous methods such as extrusion, pultrusion, or by a variations thereof in lengths of example of 50 to 100 feet or more, limited only by the equipment used to form and handle the panels. Other finite methods of forming include variations of forms of molding such as open mold, spray lay-up, or closed molding. Resins can include both thermosetting of thermoplastic materials.

Even a third embodiment of the invention, exemplified by panel 210, is shown in FIG. 7. It is again understood that the cross sectional profile shown of the panel 210 is consistent throughout a longitudinal direction of the panel, that longitudinal direction extending normal to the plane of the drawing sheet. Actually, FIG. 7 shows two panels 210*a*, 210*b* juxtaposed as they would be in operation, using a clip 300, especially a clip similar to that disclosed in the Petree '684 patent cited above. The panel 210 comprises a generally U-shaped elongate body, but the base section 212 is not a relatively thin plane, as in panel 10, but is instead a top plane 213 with an underlying cavity 215, bounded by a bottom plane 217. Unlike the embodiment in FIG. 3, the embodiment in FIG. 7 is not filled with an insulative foam, although it certainly would be in some embodiments of the invention. The base section 212 is bounded on its ends by first and second vertical legs 214, 216, one of each being shown on the respective panels 210*a*, 210*b*. The first vertical leg 214, has a first part 218 of a means 220 for mating disposed at a top end therof. The other vertical leg, that is, second vertical leg 216, also has a first part 218 of the mating means 220 disposed at a top end thereof. It is noted that the first mating parts 216, 218 of the respective vertical legs are identical, although mirror images of each other. They do not mate with each other. To achieve the mating of the first mating parts, a second mating part 222 is required and this is provided by cap member 302, shown operatively engaged on the panels 210*a*, 210*b*. In the particular embodiment shown, the first mating part 218 are male portions and the second mating part 222 is a female portion.

The embodiment shown in FIG. 7 does not show any equivalent of the longitudinal strip or band 24 of a resilient sealant or gasket which is applied to mating faces in the first two embodiments. This does not mean that such a resilient sealant or gasket would not be used. However, if the sealant or gasket were used, the primary place for positioning it would be along the V-shaped gap between the cap member 302 and the tops of mating parts 218. Alternately, it would be desirable in some situations to use a T-shaped gasket in which the horizontal arms would lie in the V-shaped gap and the vertical arm would extend in the vertical gap between the mating parts 218.

FIG. 7 also shows other features of the panel 210 and clip 300. Each side edge is also provided with a groove or channel 226, intended to receive a tongue 304 of the clip, but in this case the groove 226 is formed in the first mating part 218 at the top end of the vertical leg 214, 216, rather than at an intermediate portion of the leg, especially an intermediate portion near the base section 212. In this way, the built-up head 240 of the first mating part 218 acts as a gusset similar to one of the gussets 28, 30 of the other embodiments and the functionality of the second gusset is provided by a portion of the cap member 302, specifically part 306.

A few points are in order about cap member 302. The cap member would usually be selected from a rigid plastic material, but the material should be selected so that the channel opening 308 may selectively expand as the cap member 302 is pushed downwardly onto the respective first mating parts 218, but resiliently restore to this initial size once engaged. To help achieve this, one known method is to have a portion 308 of the cap member be less thick than other portions, so that some flexibility is provided at that point.

What is claimed is:

1. A panel system for attaching to substructure of a roof or a wall, comprising:

at least one pair of adjacent panels, each of the panels comprising an elongate body with a base section having first and second side edges, with a first leg attached at a first end thereof at the first side edge and a second leg attached at a first end thereof at the second side edge, the first and second legs extending generally perpendicularly therefrom, each said side edge further comprising a groove or channel;

each said first leg having a first means for mating arranged at a second end thereof;

each said second leg having a second means for mating, complementary to the first means for mating, arranged at a second end thereof; and at least one clip for connecting each said pair of adjacent panels, each said clip comprising a flat bottom arranged and designed to have a bottom surface fastened to the substructure, with a left, a right and a central support member each extending from an upper surface of the flat bottom, the left and right support members each having a upper surface and the central support member having a pair of outwardly extending tongues or tabs;

wherein the clip fits between the adjacent panels, with the tongues or tabs received in the grooves or channels of the adjacent panels and the base section of the one of the adjacent panels abutting the upper surface of the left support member and the base section of the other adjacent panel abutting the upper surface of the right support member.

2. The panel system of claim 1, wherein the each said groove or channel has a built-up gusset positioned thereabove.

3. The panel system of claim 2, wherein the each said groove or channel has a further built-up gusset positioned therebelow.

4. The panel system of claim 1, wherein the left and right support members increase in thickness between the flat bottom and the upper surface of the support member.

5. The panel system of claim 1, wherein the panels are formed from a thermoplastic polymer.

6. The panel system of claim 5, wherein the thermoplastic polymer has reinforcing fibers embedded therein.

7. The panel system of claim 1, wherein the panels are formed from a thermosetting polymer.

8. The panel system of claim 7, wherein the thermosetting polymer has reinforcing fibers embedded therein.

9. The panel system of claim 1, wherein the case section of each panel has the same thickness as the first and second legs.

10. The panel system of claim 1, wherein the base section comprises:

a top plane of the same thickness as the first and second legs;

a bottom plane, spaced apart from and parallel to the top plane; and side walls connecting the top and bottom planes, the top and bottom planes and the side walls defining a cavity.

11. The panel system of claim 10, wherein the cavity is filled with an insulating material.

12. The panel system of claim 1, wherein the central support member extends upwardly beyond the pair of outwardly extending tongues or tabs in a vertical channel between the first leg of the first panel and the second leg of the second panel.

13. The panel system of claim 1, wherein a single continuous clip is disposed between each pair of adjacent panels.

14. The panel system of claim 1, wherein a plurality of clips are arranged in discontinuous series between each pair of adjacent panels.

15. A panel system for attaching to substructure of a roof or a wall, comprising:

at least one pair of adjacent panels, formed from a polymeric material, each of the panels comprising an elongate channel body with a consistent cross-section throughout, having a base section with a first and a second leg extending perpendicularly away from the base section at the respective ends thereof and an elongate groove formed along each end;

each said first leg having a first means for mating arranged at a second end thereof;

each said second leg having a second means for mating, complementary to the first means for mating, arranged at a second end thereof; and at least one clip for connecting each said pair of adjacent panels, each said clip comprising a flat bottom arranged and designed to have a bottom surface fastened to the substructure, with a first and a second means for providing support to the base sections of the respective first and second panels of the adjacent pair and a central support member extending from an upper surface of the flat bottom, the central support member having a pair of outwardly extending tongues or tabs;

wherein the clip fits between the adjacent panels with the tongues or tabs received in the grooves of the adjacent panels; and wherein the panels are formed by a process such that the panels exhibit varying thickness within the cross-section.

* * * * *